US006099423A

United States Patent [19]

Ou

[11] Patent Number: 6,099,423

[45] Date of Patent: Aug. 8, 2000

[54] BASKETBALL

[75] Inventor: Tsung-Ming Ou, Kaohsiung, Taiwan

[73] Assignee: Top Ball Trading Co., Ltd., Taiwan

[21] Appl. No.: 09/247,862

[22] Filed: Feb. 11, 1999

[51] Int. Cl.[7] ..... A63B 41/08

[52] U.S. Cl. ..... 473/604

[58] Field of Search ..... 473/599, 603, 473/604, 605, 607, 609

[56] References Cited

U.S. PATENT DOCUMENTS

| | | | |
|---|---|---|---|
| 2,280,314 | 4/1942 | Scudder | 473/604 |
| 3,863,923 | 2/1975 | Anderson | 473/604 |
| 5,310,178 | 5/1994 | Walker et al. | 473/605 |
| 5,681,233 | 10/1997 | Guenther et al. | 473/605 |

*Primary Examiner*—Steven Wong

*Attorney, Agent, or Firm*—Pillsbury Madison & Sutro LLP

[57] ABSTRACT

A basketball includes a ball bladder, a plurality of cloth pieces, and a plurality of rubber patches. The ball bladder has an outer surface, which is formed with a rib network that divides the outer surface of the ball bladder into a plurality of areas and that has a top surface. Each of the areas has a periphery along which an annular recess is formed. The cloth pieces are adhered to and cover entirely the areas, respectively. Each of the cloth pieces has a periphery, which extends into the recess in the corresponding area and which abuts against the rib network. The rubber patches are adhered to and cover entirely outer surfaces of the cloth pieces, respectively. Each of the rubber patches has a periphery, which abuts against the rib network and which has an outer surface that is flush with the top surface of the rib network to define a groove network in an outer surface of the basketball along the rib network.

1 Claim, 3 Drawing Sheets

BASKETBALL

BACKGROUND OF THE INVENTION

1. Field of the Invention

This invention relates to a basketball, more particularly to a basketball having a plurality of cloth pieces and rubber patches that are adhered to an outer surface of a ball bladder.

2. Description of the Related Art

Referring to FIGS. 1A, 1B, 1C and 1D, a conventional basketball 1 is shown to include a ball bladder 11, a plurality of cloth pieces 12, and a plurality of rubber patches 13. The ball bladder 11 has an outer surface, which is formed with a rib network 110 that divides the outer surface of the ball bladder 11 into a plurality of areas 111. In the areas 111, the cloth pieces 12 are adhered to the outer surface of the ball bladder 11. The rubber patches 13 are adhered to the outer surfaces of the cloth pieces 12, respectively, to cover entirely the areas 111 of the outer surface of the ball bladder 11. During manufacture, the cloth pieces 12 are adhered to the rubber patches 13, which have the same size as the cloth pieces 12. Then, each of the assemblies of the cloth pieces 12 and the rubber patches 13 are cut into the structure shown in FIG. 1C, which has a peripheral cutout 14, and is subsequently adhered to a respective one of the areas 111 of the ball bladder 11. As such, the outer surfaces of the peripheries 131 of the patches 13 are flush with a top surface 1101 (see FIG. 1D) of the rib network 110. Because a groove network 15 is formed in the outer surface of the basketball 1 along the rib network 110, the user can easily hold the basketball 1. The aforesaid conventional basketball 1 suffers from the following disadvantages:

(1) It is time-consuming and expensive to effect a cloth-cutting process for forming the peripheral cutouts 14.

(2) It is noted that one rubber material is adhered more easily to a piece of cloth than another rubber material. Because the cloth pieces 12 have tapered peripheries 121 (see FIG. 1D), no cloths are disposed between the ball bladder 11 and the peripheries 131 of the patches 13. As a result, the peripheries 131 of the patches 13 cannot be fixed firmly to the ball bladder 11 at positions 16 (see FIG. 1D).

SUMMARY OF THE INVENTION

The object of this invention is to provide a basketball with a ball bladder, on which a plurality of cloth pieces and a plurality of rubber patches that have the same size as the cloth pieces can be fixed firmly.

According to this invention, a basketball includes a ball bladder, a plurality of cloth pieces, and a plurality of rubber patches. The ball bladder has an outer surface, which is formed with a rib network that divides the outer surface of the ball bladder into a plurality of areas and that has a top surface. Each of the areas has a periphery along which an annular recess is formed. The cloth pieces are adhered to and cover entirely the areas, respectively. Each of the cloth pieces has a periphery, which extends into the recess in the corresponding area and which abuts against the rib network. The rubber patches are adhered to and cover entirely outer surfaces of the cloth pieces, respectively. Each of the rubber patches has a periphery, which abuts against the rib network and which has an outer surface that is flush with the top surface of the rib network to define a groove network in an outer surface of the basketball along the rib network.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1A:
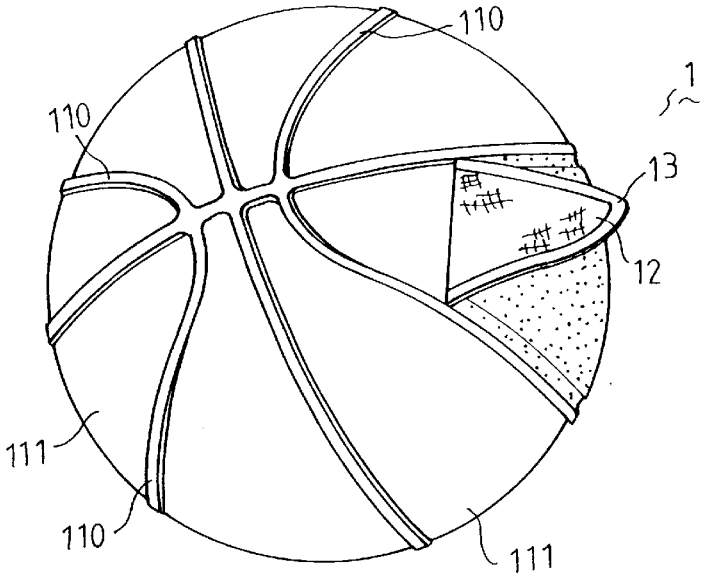
FIG. 1A PRIOR ART
FIG. 1A is a perspective view of a conventional basketball, in which a rubber patch, a portion of a cloth piece and a portion of a rubber patch are removed from a ball bladder for the sake of clarity.
Figure 1B:
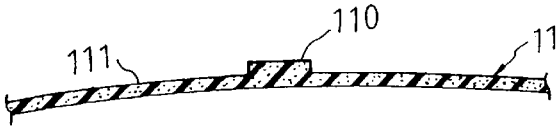
FIG. 1B PRIOR ART
FIG. 1B is a fragmentary sectional view of a wall of the ball bladder of the conventional basketball.
Figure 1C:
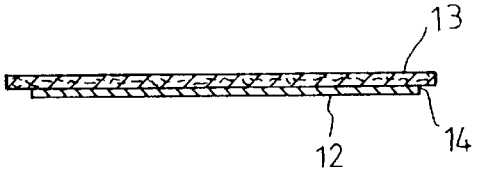
FIG. 1C PRIOR ART
FIG. 1C is a schematic view illustrating how a peripheral cutout is located in an assembly of the cloth piece and the rubber patch of the conventional basketball.
Figure 1D:
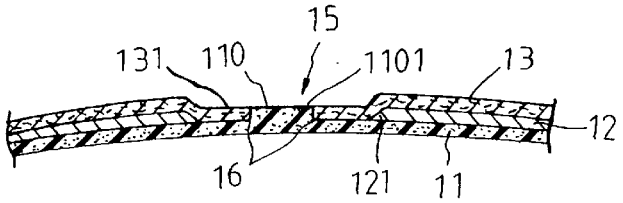
FIG. 1D PRIOR ART
FIG. 1D is a sectional view illustrating how the peripheries of the cloth pieces are provided between the ball bladder and the rubber patches of the conventional basketball.
Figure 2:
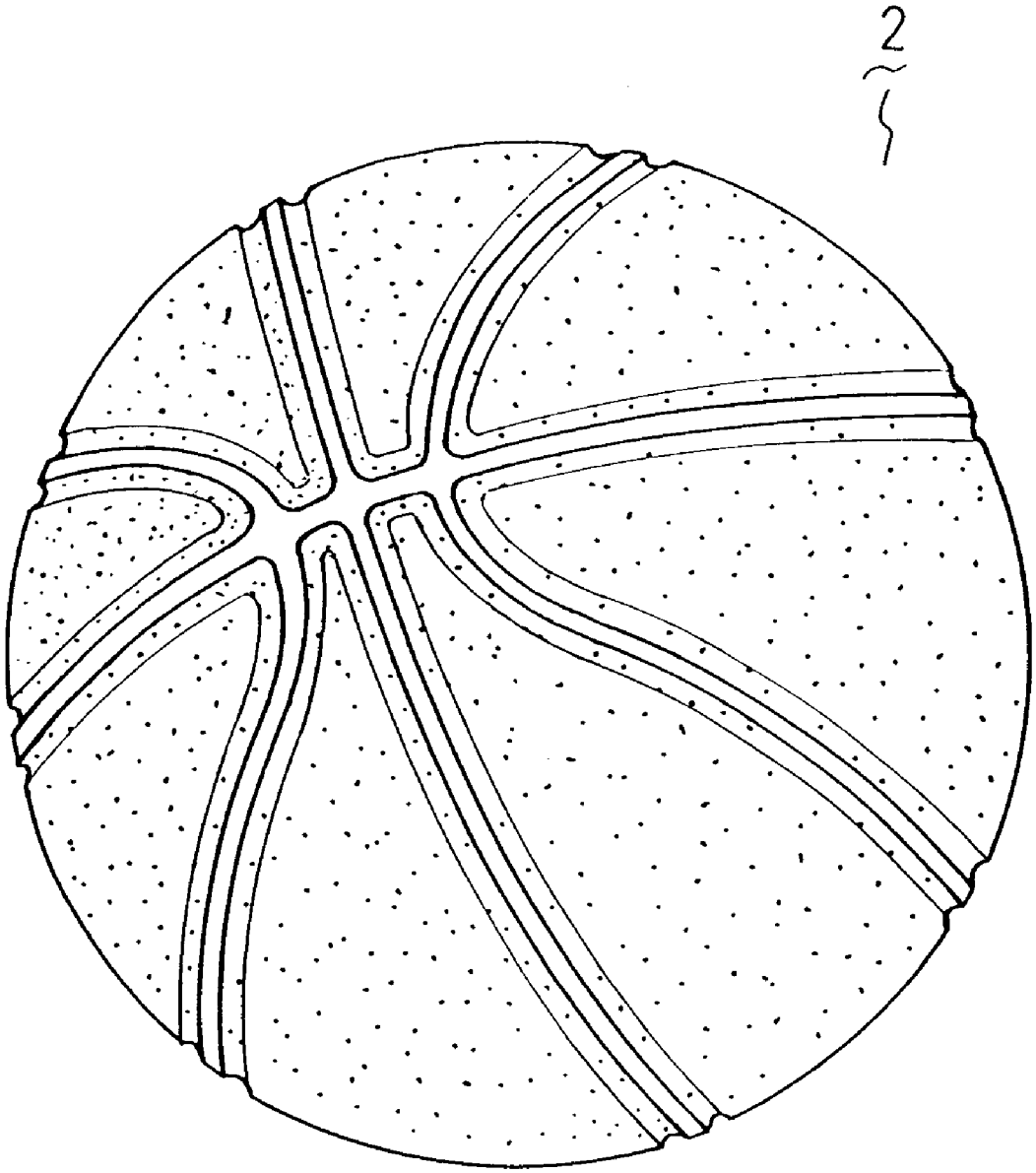
FIG. 2 is a perspective view of the preferred embodiment of a basketball according to this invention.
Figure 3A:
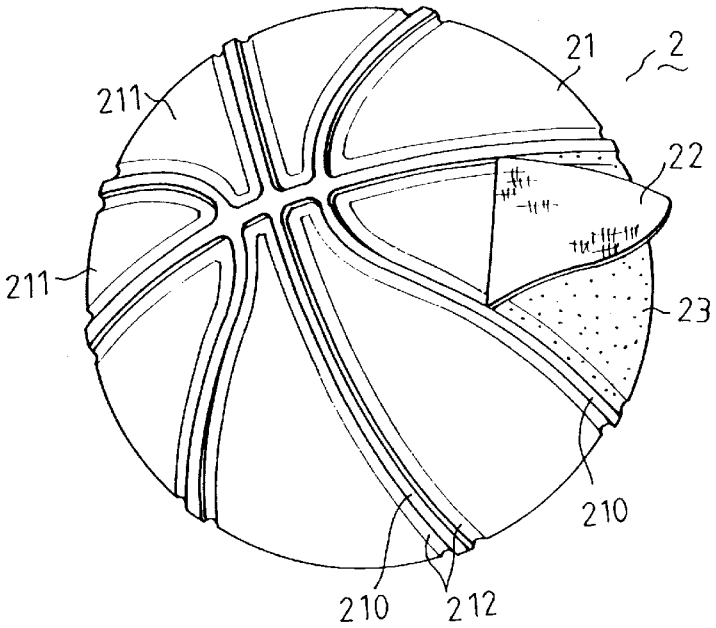
FIG. 3A is a perspective view of the preferred embodiment, in which a rubber patch, a portion of a cloth piece and a portion of a rubber patch are removed from a ball bladder for the sake of clarity.
Figure 3B:
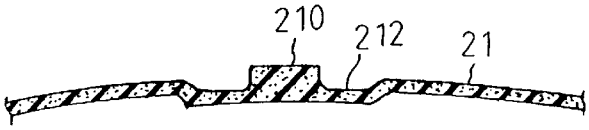
FIG. 3B is a fragmentary sectional view of a wall of the ball bladder of the preferred embodiment.
Figure 3C:
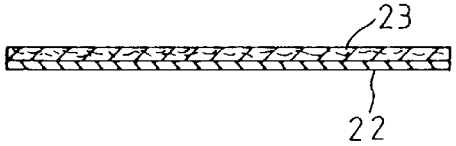
FIG. 3C is a fragmentary sectional view of an assembly of the cloth piece and the rubber patch of the preferred embodiment.
Figure 3D:
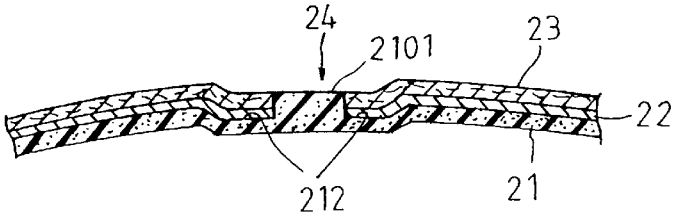
FIG. 3D is a sectional view illustrating how the peripheries of the cloth pieces are provided between the ball bladder and the rubber patches of the preferred embodiment.

Referring to FIGS. 2, 3A, 3B, 3C and 3D, the preferred embodiment of a basketball 2 according to this invention is shown. The basketball 2 includes an inflatable ball bladder 21, a plurality of cloth pieces 22, and a plurality of rubber patches 23, which have the same size as the cloth pieces 22.

The ball bladder 21 has an outer surface, which is formed with a rib network 210 that is located and shaped in a known manner. The rib network 210 divides the outer surface of the ball bladder 21 into a plurality of areas 211. Each of the areas 211 has a periphery, along which an annular recess 212 is formed.

The cloth pieces 22 are adhered to and cover entirely the areas 211, respectively. The peripheries of the cloth pieces 22 extend into the recesses 212 in the ball bladder 21, and abut against the rib network 210.

The rubber patches 23 are adhered to and cover entirely the outer surfaces of the cloth pieces 22, respectively. The peripheries of the rubber patches 23 abut against the rib network 210, and have outer surfaces, which are flush with the top surface 2101 of the rib network 210. Accordingly, a groove network 24 is formed in the outer surface of the basketball 2 along the rib network 210.

Because the periphery of each of the cloth pieces 22 is interposed between the corresponding rubber patch 23 and the ball bladder 21, the rubber patches 23 can be fixed firmly to the ball bladder 21.

With this invention thus explained, it is apparent that numerous modifications and variations can be made without departing from the spirit and scope of this invention. It is therefore intended that this invention be limited only as indicated in the appended claims.

I claim:

1. A basketball comprising:

a ball bladder having an outer surface, which is formed with a rib network that divides said outer surface of said ball bladder into a plurality of areas and that has a top surface, each of said areas having a periphery, along which an annular recess is formed;

a plurality of cloth pieces adhered to and covering entirely said areas, respectively, each of said cloth pieces having a periphery, which extends into said recess in a corresponding one of said areas and which abuts against said rib network; and a plurality of rubber patches adhered to and covering entirely outer surfaces of said cloth pieces, respectively, each of said rubber patches having a periphery, which abuts against said rib network and which has an outer surface that is flush with said top surface of said rib network to define a groove network in an outer surface of said basketball along said rib network.

* * * * *